US008074821B2

(12) United States Patent
Yeager

(10) Patent No.: US 8,074,821 B2
(45) Date of Patent: Dec. 13, 2011

(54) CHILD-RESISTANT CONTAINER AND CONTAINER CAP

(75) Inventor: Don F. Yeager, Millville, NJ (US)

(73) Assignee: McNeil-PPC, Inc., Skillman, NJ (US)

( * ) Notice: Subject to any disclaimer, the term of this patent is extended or adjusted under 35 U.S.C. 154(b) by 1480 days.

(21) Appl. No.: 11/375,774

(22) Filed: Mar. 15, 2006

(65) Prior Publication Data

US 2007/0228042 A1 Oct. 4, 2007

(51) Int. Cl.
*B65D 51/18* (2006.01)
*B65D 43/04* (2006.01)
*B67B 1/00* (2006.01)

(52) U.S. Cl. ..... 220/254.3; 215/204; 215/237; 220/254.7; 220/281; 220/839; 222/153.02; 222/153.14; 222/556

(58) Field of Classification Search ..... 215/237, 215/295, 216, 224, 225; 220/254.3, 839; 222/153.14, 556
See application file for complete search history.

(56) References Cited

U.S. PATENT DOCUMENTS

| | | | | |
|---|---|---|---|---|
| 4,752,013 | A | 6/1988 | Miller et al. | |
| 4,752,014 | A | 6/1988 | House et al. | |
| 5,449,077 | A | 9/1995 | Seidler | |
| 5,765,705 | A | 6/1998 | Deubel | |
| 5,860,543 | A | 1/1999 | Decelles | |
| 6,021,901 | A | 2/2000 | Wolfe | |
| 6,405,885 | B1 | 6/2002 | Elliott | |
| 6,439,409 | B1 | 8/2002 | Dressel et al. | |
| 6,866,164 | B2 | 3/2005 | Branson et al. | |
| D515,917 | S | 2/2006 | Hierzer et al. | |
| 2004/0195241 | A1 | 10/2004 | Stull | |
| 2005/0133475 | A1 * | 6/2005 | Goto et al. | 215/237 |
| 2006/0231518 | A1 * | 10/2006 | Suffa | 215/237 |

FOREIGN PATENT DOCUMENTS

| | | |
|---|---|---|
| EP | 1505004 | 2/2005 |
| WO | 9004546 | 5/1990 |
| WO | WO2004 080839 | 9/2004 |

* cited by examiner

*Primary Examiner* — Robin Hylton
(74) *Attorney, Agent, or Firm* — Karen G. Horowitz

(57) ABSTRACT

A container assembly including a container and a cap disposed on the container. The cap is moveable between a closed condition and an open condition. The cap has two opposing side wall regions and an end region disposed between the two opposing side wall regions. At least one of the side wall regions has a container-engaging portion moveable between a closed position where the container-engaging portion engages the container to resist opening of the cap, and a second position where the container-engaging portion is disengaged from the container to allow opening of the cap. The end region of the cap is in a snap-fit relationship with the container. Also included is a cap having these features.

27 Claims, 6 Drawing Sheets

CHILD-RESISTANT CONTAINER AND CONTAINER CAP

FIELD OF INVENTION

The present invention relates to containers, and more specifically to child-resistant containers and container caps for medicines.

BACKGROUND OF INVENTION

Containers for products which could be harmful to children (such as medicines, pharmaceuticals, nutriceuticals, etc.) have been designed to make it difficult for children to open them, while allowing access by adults. These containers are often referred to as "child-resistant" containers. A challenge in the past, however, is that many such products are used by older adults, or adults with disabilities. The extent of dexterity loss, through age or disability or otherwise, makes the use of these child-resistant containers difficult for some.

Various attempts have been made, therefore, to provide a child-resistant container which is difficult for a child to open but easy for an adult to open, even where the adult has diminished dexterity for any reason. Many of these designs, however, can be difficult to manufacture cheaply, and some require multiple parts or difficult molding techniques.

There exists a need to provide a child-resistant container that can be easily and cheaply manufactured, while remaining difficult for a child to open but easy for an adult to open.

SUMMARY OF INVENTION

The present invention provides a container comprising a container and a cap disposed on the container. The cap is moveable between a closed condition and an open condition. The cap has two opposing side wall regions and an end region disposed between the two opposing side wall regions. At least one of the side wall regions has a container-engaging portion moveable between a closed position where the container-engaging portion engages the container to resist opening of the cap, and a second position where the container-engaging portion is disengaged from the container to allow opening of the cap. The end region of the cap is in a snap-fit relationship with the container wherein the cap is moveable from the closed condition to the open condition by a user moving the container-engaging portion to its second position and applying a force to the end region sufficient to overcome the snap fit.

The present invention further provides a cap for a container comprising an upper portion and a base. The base is configured to be attached to, or form part of, a container. The upper portion and base are joined by a hinge. The upper portion is moveable between a closed condition and open condition. The upper portion has two opposing side wall regions and an end region disposed between the two opposing side wall regions. At least one of the side wall regions has a base-engaging portion moveable between a closed position wherein the base-engaging portion engages the base to resist opening of the container, and a second position wherein the base-engaging portion is disengaged from the base to allow opening of the container. The end region of the upper portion is in a snap-fit relationship with the base. The upper portion is moveable from its closed condition to the open condition by a user moving the base-engaging portion to its second position and applying a force to the end region sufficient to overcome the snap fit.

The present invention also provides a method of opening the cap described above. The method comprises the steps of grasping the container with a first hand; urging the container-engaging portion toward its second position with a thumb or finger of the second hand; and using the thumb of the first hand to contact the end region and urge the cap to its open condition.

The present invention also provides a cap assembly comprising a lower cap portion adapted to be connected to a container. The lower cap portion is adapted to be connected to a container. The lower cap portion comprises two opposing lower side wall regions and a lower end region disposed between the two opposing lower side wall regions. At least one of the opposing lower side wall regions include a lower engagement portion. An upper cap portion is adapted for releasable engagement with the lower cap portion. The upper cap portion comprises two opposing upper side wall regions and an upper end region disposed between the two opposing upper side wall regions. At least one of the upper side wall regions has a lower cap-engaging portion moveable between a closed position wherein the upper cap portion engages the lower cap-engaging portion to resist opening of the cap assembly, and a second position wherein the upper cap portion is disengaged from the lower cap-engaging portion to allow opening of the cap assembly. The upper end region is in a snap-fit relationship with the lower end region in the closed condition.

The present invention further includes a method of opening a cap having a lower portion and an upper portion. The lower portion has a lower engagement portion and the upper portion has two opposing side wall regions and an end region disposed between the side wall regions. At least one of the side wall regions includes an upper engagement portion operable between a closed position wherein the upper engagement portion engages the lower engagement portion and a second position wherein the upper engagement portion is disengaged from the lower engagement portion to allow opening of the cap. The method comprises the steps of urging the upper engagement portion toward the second position with at least one of the thumb and a finger of a hand and using the thumb of another hand to urge the end region of the upper portion away from the lower portion.

BRIEF DESCRIPTION OF THE FIGURES

The foregoing summary, as well as the following detailed description of preferred embodiments of the invention, will be better understood when read in conjunction with the appended drawings, which are incorporated herein and constitute part of this specification. For the purposes of illustrating the invention, there are shown in the drawings embodiments that are presently preferred. It should be understood, however, that the invention is not limited to the precise arrangements and instrumentalities shown. In the drawings, the same reference numerals are employed for designating the same elements throughout the several figures. In the drawings.

DETAILED DESCRIPTION OF INVENTION

Figure 1:
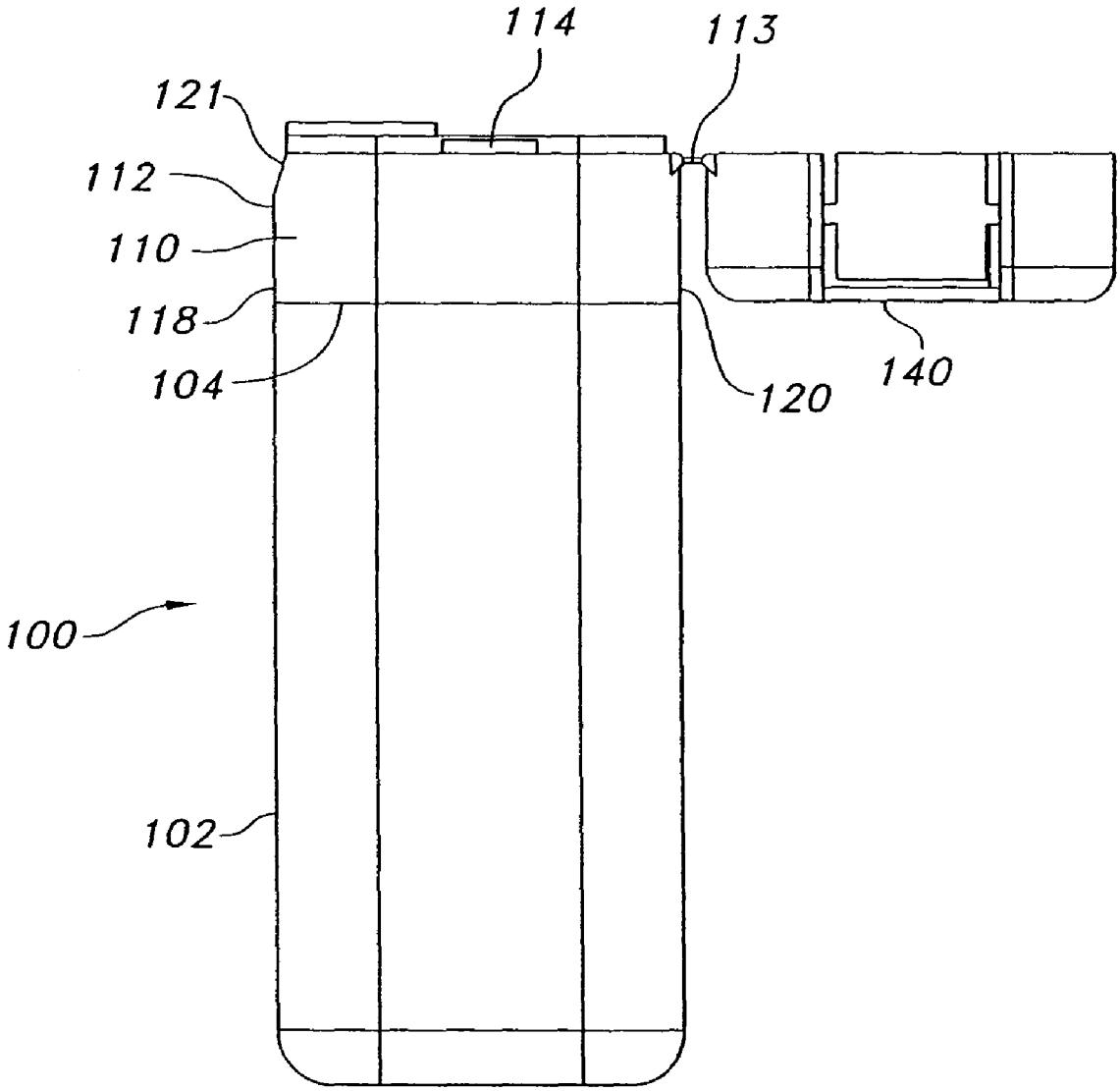
FIG. 1 is a side profile view of a container and cap assembly according to a first embodiment of the present invention, with the assembly in an open condition.

Certain terminology is used herein for convenience only and is not to be taken as a limitation on the present invention. The terminology includes the words specifically mentioned, derivatives thereof and words of similar import. As used herein, the term "top" is defined to mean closer to the top of the page when the container is oriented in a position as shown in FIG. 1. The following describes preferred embodiments of the invention. However, it should be understood based on this disclosure that the invention is not limited by the preferred embodiments of the invention.

Referring to the Figures in general, a child-resistant container and cap assembly 100 according to the several embodiments of the present invention is shown. Referring specifically to FIG. 1, assembly 100 includes a container 102 that receives and retains a medicament or other dispensable article. The article may be in tablet, liquid, or other form suitable for dispensing from assembly 100 through a cap 110 located at the top of container 102. Assembly 100 may be sized for use as a travel-size container. Alternatively, assembly 100 may be sized for standard dispensing volumes.

Container 102 may be transparent to allow a user to see the volume of dispensable article within container 102. Alternatively, container 102 may be opaque to preclude light from reaching articles within container 102 that may be susceptible to light damage. Container 102 is constructed from a polymer, such as high density polyethylene (HDPE), polypropylene, or blend of polymers in order to maintain its shape and rigidity. Container 102 includes an opening 104 in fluid communication with cap 110 in order to allow the dispensable article to be dispensed from container 102 through cap 110.

Cap 110 is also constructed from a polymer, such as HDPE, polypropylene, or a blend of polymers. Cap 110 may be opaque and may be optionally contain certain colorants to enable a user to associate a specific type of article in the container 102 with the color of the cap 110.

Referring in particular to FIGS. 1-6, cap 110 includes a lower, or base, portion 112 that is attached to container 102 at or near the opening 104. Although in the embodiments shown herein, lower portion 112 is a separate element from container 102, those skilled in the art will recognize that lower portion 112 may be part of, or integrally formed with, container 102. Cap 110 also includes an upper, or lid, portion 140 that is hingedly connected to lower portion 112 by a flexible hinge 113.

Figure 2:
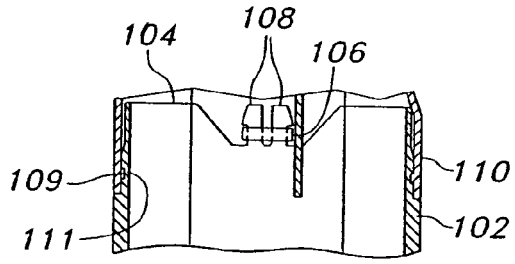
FIG. 2 is a sectional view of the interior of the container and cap assembly of FIG. 1 showing connection details of the cap with the container and cap shown.
Figure 3:
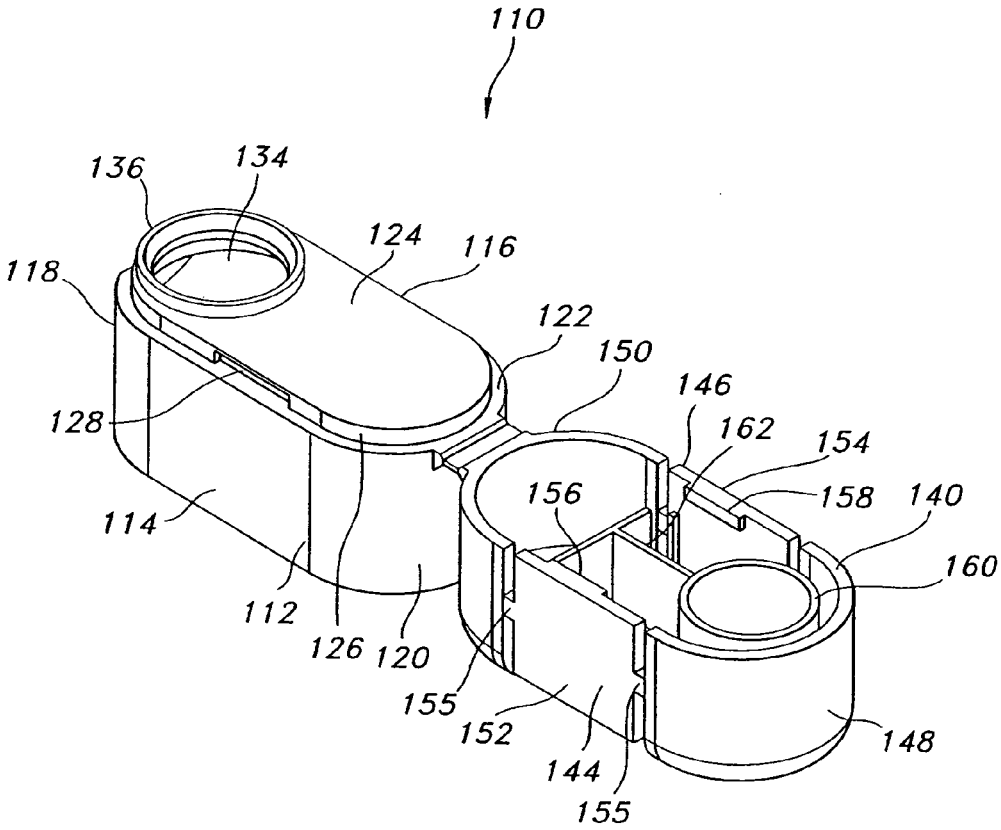
FIG. 3 is a perspective view of the cap of FIG. 1.
Figure 4:
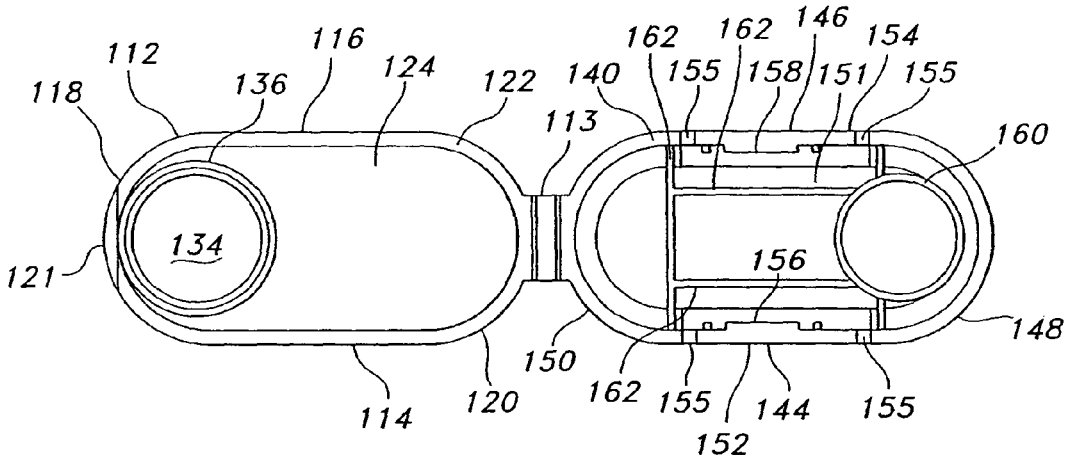
FIG. 4 is a top plan view of the cap of FIG. 1.
Figure 5:
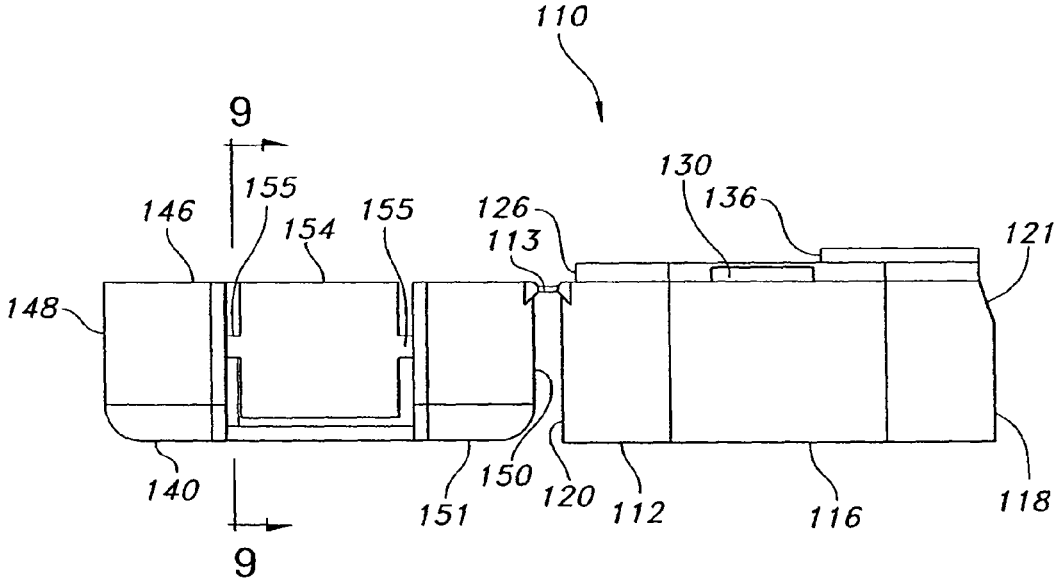
FIG. 5 is a side profile view of the cap of FIG. 1.
Figure 6:
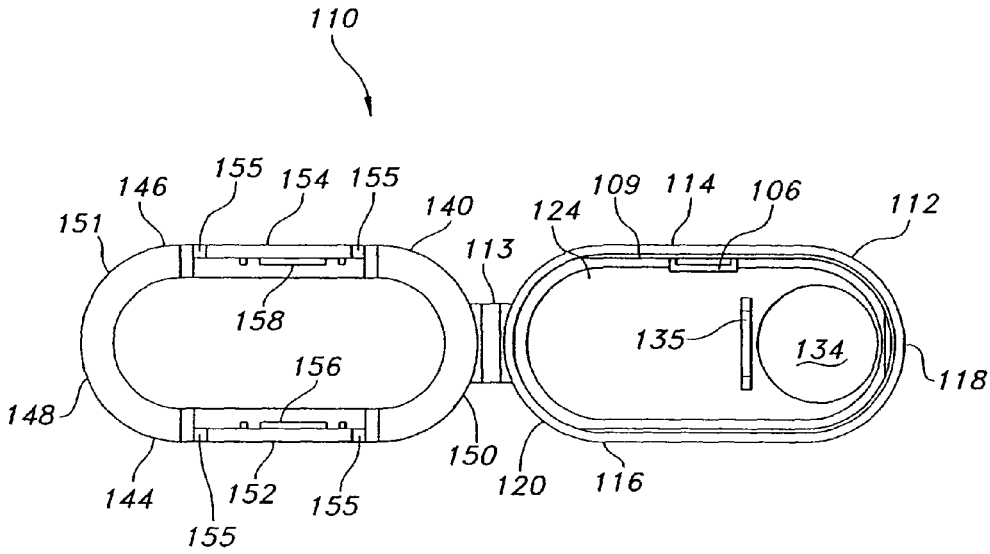
FIG. 6 is a bottom plan view of the cap of FIG. 1.

Cap 110 may be retained on container 102, such as with an adhesive (not shown), or alternatively, in a frictional fit. Alternatively or additionally, as shown in FIGS. 2 and 6, cap 110 may include a retaining well 106 that extends inwardly from an inside surface a wall of cap 110. Retaining well 106 accepts and retains bayonet clips 108 that are formed in container 102 to provide additional retaining strength between cap 110 and container 102. Further, in this particular embodiment, a rib 109 extends at least partially around the inner perimeter of cap 110 and fits into a groove 111 in container 102 to further retain cap 110 onto container 102.

In the exemplary embodiments shown in the Figures, lower portion 112 is generally oblong in plan view, with two major, opposing, generally parallel side wall regions 114, 116, connected by a curved front region 118 and a curved rear region 120. Curved front region 118 includes a finger relief 121 that is used to assist in opening cap 110. Hinge 113 extends from curved rear region 120 and connects curved rear region 120 to upper portion 140.

Referring specifically to FIGS. 3-6, lower portion 112 includes a peripheral lip 122 that extends around a perimeter of lower portion 112. A raised planar top surface 124 extends across the top of lower portion 112 within the perimeter of lip 122, defining lip 122. A connecting wall 126 circumscribes top surface 124 and connects top surface 120 to lip 122. Connecting wall 126 includes lower engagement portions in the form of recesses 128, 130, 132 formed therein, with recesses 128, 130 aligned with side wall regions 114, 116 and recess 132 aligned with front portion 118.

Top surface 124 includes an opening 134 that allows communication between the interior of container 102 and the exterior of container 102. Opening 134 is generally circular, with a raised lip 136 circumscribing opening 134. Referring to FIG. 6, a retainer plate 135 extends from the inside top surface 124 proximate to opening 134. Retainer plate 135 extends approximately the height of lower portion 112. Retainer plate 135 restricts the flow of articles from container 102 through opening 134 particularly when container 102 is full or nearly full, so that excess articles are not dispensed from container assembly 100. Retainer plate 135 forms a "tunnel effect" to limit flow of articles into opening 134 so that only one article is presented through opening 134 at a time.

Figure 7:
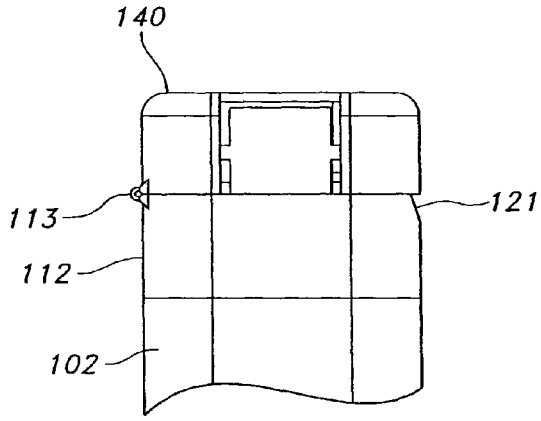
FIG. 7 is side profile view of the top portion of the container and cap assembly of FIG. 1, with the assembly in a closed condition.

Upper portion 140 is generally oblong in plan view, with two major, opposing, generally parallel side wall regions 144, 146, connected by a curved front region 148 and a curved rear region 150. Upper portion 140 further includes a top 151 that connects side wall regions 144, 146, front region 148, and rear region 150. Hinge 113 connects lower portion 112 to rear portion 150 and allows upper portion 140 to move between a first, or open, position and a second, or closed position. Upper portion 140 has approximately the same perimeter dimensions as lower portion 112 so that when cap 110 is in a closed condition, the perimeter of lower portion 112 generally aligns with the perimeter of upper portion 140, as shown in FIG. 7. However, finger relief 121 forms a gap between lower portion 112 and upper portion 140. The gap assists in moving cap 110 from a closed condition to an open condition.

Referring back to FIGS. 3-6, each of side wall regions 144, 146 includes a container-engaging portion comprised of a hinged plate 152, 154, respectively. Plates 152, 154 are hinged on hinges 155 approximately half way along a height of the plate. Each plate 152, 154 includes a base-engaging portion in the form of a protrusion 156, 158 that extends inwardly. Protrusions 156, 158 are sized to fit within recesses 128, 130, respectively in a male/female relationship. Plates 152, 154 are moveable about their respective hinges between the closed position, wherein each protrusion 156, 158 engages its respective recess 128, 130 to resist opening of cap 110 when cap 110 is in a closed condition, and the open position, wherein protrusions 156, 158 are withdrawn from their respective recesses 128, 130 to allow opening of cap 110.

The interior of upper portion 140 at front region 148 includes a circular male pintle 160 that extends into opening 134 in top surface 124 of lower portion 112 when cap 110 is in a closed condition. Pintle 160 engages the wall defining opening 134 in a frictional fit sufficient to require additional force to be applied to open cap 110 when plates 152, 154 are in their open position. Further, the engagement between pintle 160 and the wall defining opening 134 provides a fluid-tight seal to preclude moisture from entering container 102 when cap 110 is in the closed condition. Such a seal is beneficial for medicaments that may be stored within container and cap assembly 100 for extended periods of time to prevent caking of the medicaments.

Although both opening 134 and pintle 160 are shown in the Figures to be generally circular, those skilled in the art will recognize that opening 134 and pintle 160 may be other shapes, so long as the shapes are complementary to each other and pintle 160 can be inserted into opening 134 such that pintle 160 engages the wall forming opening 134 in a frictional fit. A plurality of support ribs 162 extend along the interior of upper portion 140 to provide structural support for upper portion 140.

Figure 8:
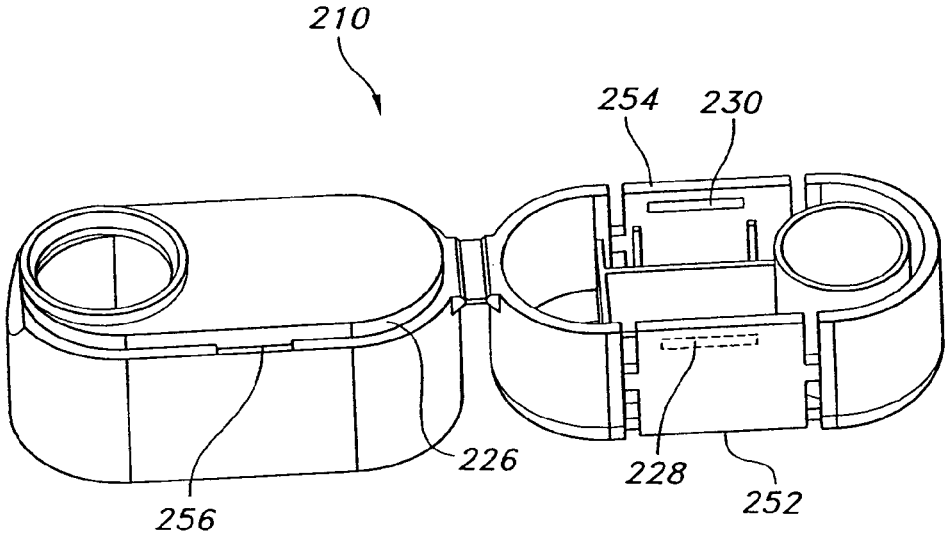
FIG. 8 is a perspective view of a cap according to a second embodiment of the present invention.

Although the embodiment shown in FIGS. 3-6 includes recesses 128, 130 formed in connecting wall 126 and protrusions 156, 158 extending from plates 152, 154, in an alternative embodiment of cap 210 as shown in FIG. 8, recesses 228, 230 may be formed in plates 252, 254, and protrusions 256, 258 may extend from a connecting wall 226.

Figure 9:
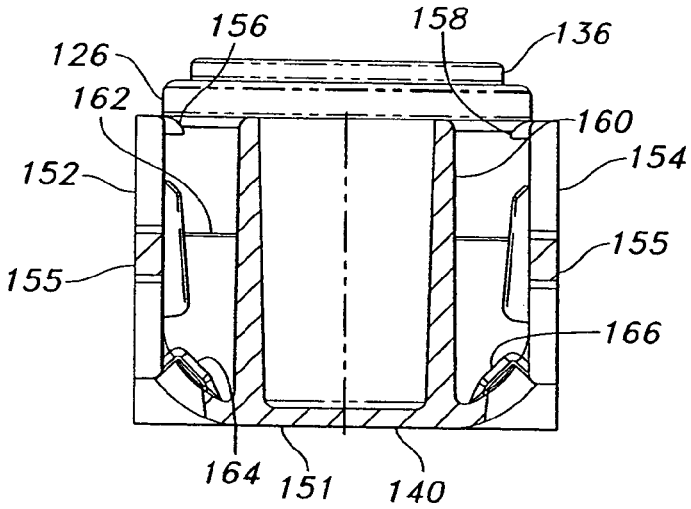
FIG. 9 is a sectional view of the cap taken along lines 9-9 of FIG. 5, showing optional springs connecting side plates to a top of the cap.

Optionally, as shown in FIG. 9, springs 164, 166 extend from top 151 to plates 152, 154 respectively. Springs 164, 166 may be molded as part of cap 11 and are, consequently, constructed from the same material as cap 110. Springs 164, 166 urge plates 152, 154 toward the closed position. Springs 164, 166 require an additional amount of force to urge plates 152, 154 toward the open position. Such additional force may frustrate small children from opening cap 110. Springs 164, 166 also provide a quick return of plates 152, 154 toward the closed position, which typically must be able to fully cycle at least 50 times between the open position and the closed position in order to be considered to properly operate.

Figure 10:
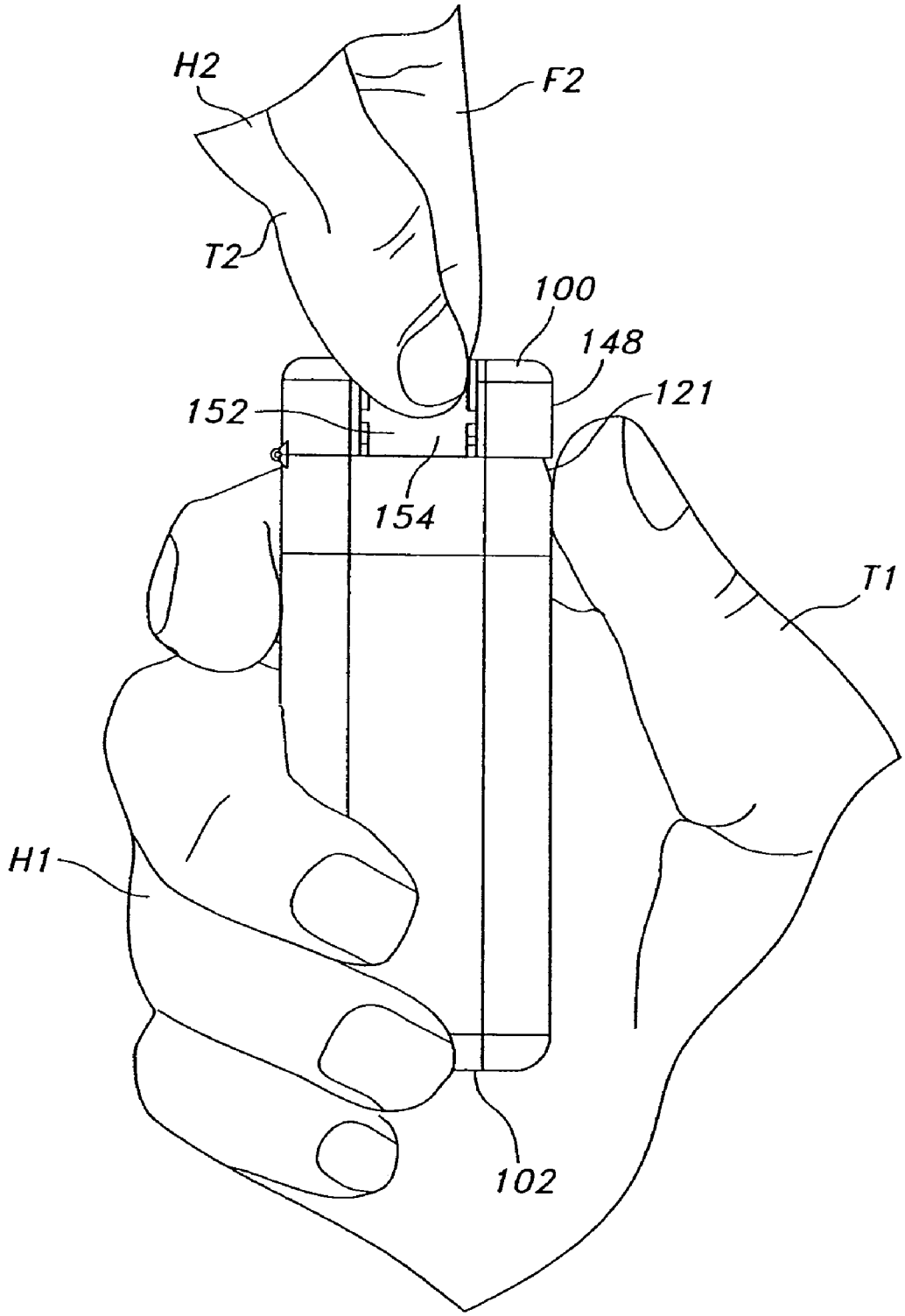
FIG. 10 is a side profile view showing a grip for opening the cap of FIG. 7.

The opening of the container and cap assembly 100 during proper use requires two hands and an amount of dexterity not normally exhibited by small children, in order to frustrate small children from opening container and cap assembly 100. In an exemplary method of opening cap 110 to dispense an article from container 102, shown in FIG. 10, a first hand H1 grasps assembly 100 around container 102. A second hand H2 grips top portion 140 such that the thumb T2 of second hand H2 engages plate 152 above its hinge and a finger F2 of second hand H2 engages plate 154 above its hinge. The finger F2 and thumb T2 of second hand H2 press toward each other, urging the plates 152, 154 from the closed position to the open position by overcoming springs 164, 166 and pivoting plates 152, 154 about their respective hinges, and freeing protrusions 156, 158 from their respective recesses 128, 130. Generally simultaneously, the thumb T1 of first hand H1 is inserted into the gap formed by finger relief 121 and against the front region 148. Thumb T1 is urged against top portion 140, overcoming the frictional fit of pintle 160 within opening 134 and urging top portion 140 upward, thereby moving cap 110 from the closed to the open condition.

To close cap 110, the user grasps container 102 with first hand H1 and urges front region 148 of top portion 140 about hinge 113 and toward front region 118 of lower portion 112 with second hand H2. Pintle 160 is forced into opening 134 and protrusions 156, 158 enter respective recesses 128, 130, locking top portion 140 to lower portion 112.

Those skilled in the art will recognize that pivoting plate 152 may be eliminated, leaving only pivoting plate 154, such that only one of finger F2 and thumb T2 of second hand H2 is required to pivot plate 152 about its hinge, removing protrusion 156 from recess 128, and allowing thumb T1 of first hand H1 to urge top portion 140 upward and opening cap 110. However, in all embodiments described above, it is recognized that two hands are required to act in concert to open the inventive cap.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A container closure comprising an upper portion and a lower portion, wherein:

said lower portion is configured to be attached to or to form a part of a container;

said upper portion is moveable between a closed condition engaging said lower portion and an open condition disengaged from said lower portion;

said upper portion has two opposing side wall regions;

at least one of said upper portion side wall regions has an inwardly directed lower-portion-engaging portion moveable between a first position where said inwardly directed lower-portion-engaging portion engages said lower portion to resist opening of said upper portion, and a second position where said inwardly directed lower-portion-engaging portion moves outwardly from said lower portion to be disengaged from said lower portion to allow opening of said upper portion; and said upper portion and said lower portion have approximately the same perimeter dimensions so that when said upper portion is in said closed condition the perimeter of said lower portion, including side wall regions of said lower portion, generally aligns with the perimeter of said upper portion including said side wall regions and inwardly directed lower-portion-engaging portion of said upper portion.

2. The container closure of claim 1, wherein said inwardly directed lower-portion-engaging portion comprises a plate engageable with said lower portion in a male/female relationship.

3. The container closure of claim 1, wherein said inwardly directed lower-portion-engaging portion comprises a plate having one of a protrusion and a recess that engages with the other of a protrusion and a recess in said lower portion when said inwardly directed lower-portion-engaging portion is in said second position.

4. A container assembly comprising a container and a container closure comprising an upper portion and a lower portion, wherein:

said lower portion is configured to be attached to said container;

said upper portion is moveable between a closed condition engaging said lower portion and an open condition disengaged from said lower portion;

said upper portion has two opposing side wall regions;

at least one of said upper portion side wall regions has an inwardly directed lower-portion-engaging portion moveable between a first position where said inwardly directed lower-portion-engaging portion engages said lower portion to resist opening of said upper portion, and a second position where said inwardly directed lower-portion-engaging portion moves outwardly from said lower portion to be disengaged from said lower portion to allow opening of said upper portion;

said upper portion and said lower portion have approximately the same perimeter dimensions so that when said upper portion is in said closed condition the perimeter of said lower portion, including side wall regions of said lower portion, generally aligns with the perimeter of said upper portion including said side wall regions and inwardly directed lower-portion-engaging portion of said upper portion; and said lower portion is attached to said container and said container has the same perimeter dimensions as said lower portion of said container closure.

5. The container closure of claim 1, wherein said inwardly directed lower-portion-engaging portion comprises a plate engageable with said lower portion, said plate pivotable at a central region between said first position and said second position.

6. The container closure of claim 1, wherein said upper portion has two lower-portion-engaging portions, each comprising a plate engageable with said lower portion, each plate pivotable at a central region between its respective first position and second position.

7. The container closure of claim 1, wherein said upper portion has two container-engaging portions, each comprising a plate, each plate having one of a protrusion and a recess engageable with the other of a protrusion and a recess on said lower portion, and each plate pivotable at a central region between its respective first position wherein the protrusion engages the recess, and second position wherein the protrusion is free of the recess.

8. The container closure of claim 1, wherein said upper portion and said lower portion are engaged in a manner requiring additional force to move said upper portion away from said lower portion when said inwardly directed lower-portion-engaging portion is in said second position.

9. The container closure of claim 8, wherein said upper portion and said lower portion are engaged together in a fluid-tight seal requiring said additional force to move said upper portion away from said lower portion.

10. The container closure of claim 1, further comprising a spring urging said inwardly directed lower-portion-engaging portion toward its first position.

11. A cap for a container, said cap comprising an upper portion and a lower portion;

wherein:

said upper portion is coupled to said lower portion and pivotable with respect to said lower portion between a closed condition engaged with said lower portion and an open condition disengaged from said lower portion;

said upper portion is generally oblong in plan view, with two major, opposing side wall regions connected by a front region and a rear region opposite said front region, and a top connecting said side wall regions, said front region, and said rear region;

at least one of said side wall regions has a lower-portion-engaging portion moveable between (a) a first position engaging said lower portion to resist movement of said upper portion into said open condition, and (b) a second position disengaged from said lower portion to allow movement of said upper portion into said open condition;

said upper portion is moveable from said closed condition to said open condition by a user (a) pressing an upper region of said at least one side wall region toward the other of said opposing side wall regions with at least two fingers of one of the user's hands to move said lower-portion-engaging portion of said at least one side wall region into said first position, and (b) applying a force to said upper portion of said cap with at least one finger of the other of the user's hands to move said upper portion of said cap into said open condition; and said upper region of said at least one side wall region does not extend above said top of said upper portion such that said at least one side wall region blends smoothly with the outer perimeter of said upper portion without protruding from or being indented within said upper portion.

12. The cap of claim 11, wherein:

each of said side wall regions has a lower-portion-engaging portion moveable between a first position engaging said lower portion to resist movement of said upper portion into said open condition, and a second position in which said lower-portion-engaging portion is disengaged from said lower portion to allow movement of said upper portion into said open condition.

13. The cap of claim 11, wherein said lower-portion-engaging portion comprises a plate having one of a protrusion and a recess that engages with the other of a protrusion and a recess in said lower portion when said upper portion is in said closed condition.

14. The cap of claim 11, wherein said lower-portion-engaging portion comprises a plate pivotable about a hinge to move between said first position and said second position.

15. The cap of claim 14, wherein:

said hinge is positioned between said upper region of said at least one of said side wall regions and a lower region of said at least one of said side wall regions; and said upper portion is moved from said closed position to said open position by pressing said upper region of said at least one of said side wall regions above said hinge.

16. The cap of claim 12, wherein said lower-portion-engaging portions of said at least one of said side wall regions comprises a plate engageable with said lower portion, said plate being pivotable at a central region to move between its respective first position and second position.

17. The cap of claim 16, wherein said upper portion is movable from said closed condition to said open condition by pressing said at least one of said side wall regions above said central region thereof toward the other of said side wall regions to move said upper portion from said closed condition to said open condition.

18. The cap of claim 17, wherein said upper portion includes a portion in frictional engagement with a portion of said lower portion sufficient to require additional force to open said upper portion when said lower-portion-engaging portion is in said second position.

19. A method of opening a cap comprising an upper portion and a lower portion, said method comprising:

grasping said upper portion of said cap with one of a user's hands;

grasping said lower portion of said cap with the other of the user's hands;

urging upper regions of said upper portion of said cap towards each other with the thumb and a finger of said one of the user's hands; and using at least one finger of said other of the user's hands to contact said cap and to urge said cap to its open condition;

wherein:

said upper portion of said cap is generally oblong in plan view, with two major, opposing side wall regions connected by a front region and a rear region opposite said front region, and a top connecting said side wall regions, said front region, and said rear region;

said upper portion is coupled to said lower portion along said rear region of said upper portion and is pivotable with respect to said lower portion between a closed condition engaged with said lower portion and an open condition disengaged from said lower portion;

at least one of said side wall regions has a lower-portion-engaging portion moveable between (a) a first position engaging said lower portion to resist movement of said upper portion into said open condition, and (b) a second position disengaged from said lower portion to allow movement of said upper portion into said open condition;

said upper region of said at least one side wall region does not extend above said top of said upper portion such that said at least one side wall region blends smoothly with the outer perimeter of said upper portion without protruding from or being indented within said upper portion;

said upper portion is moveable from said closed condition to said open condition by a user (a) pressing an upper region of said at least one side wall region toward the other of said opposing side wall regions with at least two fingers of one of the user's hands to move said lower-portion-engaging portion of said at least one side wall region into said first position, and (b) applying a force to said upper portion of said cap with at least one finger of the other of the user's hands to move said upper portion of said cap into said open condition; and using at least one finger of said other of the user's hands to contact said cap includes contacting said front region of said upper portion of said cap to pivot said upper portion with respect to said lower portion to urge said cap to its open condition.

20. The method of claim 19, wherein:

said at least one of said side wall regions comprises a plate pivotable at a central region between a closed position in which a lower-portion-engaging portion of said plate engages said lower portion and a second position in which said lower-portion-engaging portion of said plate disengages said lower portion; and said method further comprises pressing an upper region of said plate above said central region to move said lower-portion-engaging portion toward said second position.

21. The method of claim 19, wherein urging said upper regions of said upper portion of said cap towards each other and urging said cap to its open condition are performed simultaneously.

22. The cap of claim 1, wherein said cap lower portion is hingedly connected to said cap upper portion.

23. The cap of claim 11, wherein said cap lower portion is hingedly connected to said cap upper portion.

24. The cap of claim 11, wherein said upper cap portion comprises a portion in frictional engagement with a portion of said lower portion sufficient to require additional force to open said upper portion after pressing said upper region of said opposing side wall regions toward each other to move said lower-portion-engaging portion into said second position.

25. The cap of claim 24, wherein said upper portion engages said lower portion in a fluid-tight seal.

26. The cap of claim 11, further comprising a spring urging said lower-portion-engaging portion toward its second position.

27. The method of claim 19, wherein:

said upper portion has a portion in frictional engagement with a portion of said lower portion sufficient to require additional force to open said upper portion after pressing said upper regions of said upper portion of said cap toward each other to move said lower-portion engaging portion into said second position; and opening said cap further comprises urging said upper portion away from said lower portion with at least one of the thumb and a finger of said other of the user's hands to overcome the frictional engagement of said upper portion and said lower portion to urge said upper portion away from said lower portion.

* * * * *